US006735797B1

(12) United States Patent
Long et al.

(10) Patent No.: US 6,735,797 B1
(45) Date of Patent: May 18, 2004

(54) ADJUSTABLE BED SYSTEM

(75) Inventors: Thomas P. Long, Webb City, MO (US); Paul E. Pottschmidt, Lexington, NC (US); Jack E. Haley, Linwood, NC (US)

(73) Assignee: L&P Property Management Company, South Gate, CA (US)

( * ) Notice: Subject to any disclaimer, the term of this patent is extended or adjusted under 35 U.S.C. 154(b) by 33 days.

(21) Appl. No.: 09/994,186

(22) Filed: Nov. 26, 2001

Related U.S. Application Data

(60) Provisional application No. 60/253,065, filed on Nov. 24, 2000.

(51) Int. Cl.[7] ..... A47C 17/80; A47C 17/70

(52) U.S. Cl. ..... 5/118; 5/618

(58) Field of Search ..... 5/118, 613, 617, 5/618; 296/190.02

(56) References Cited

U.S. PATENT DOCUMENTS

| | | | | | |
|---|---|---|---|---|---|
| 3,371,359 | A | | 3/1968 | Dome | 5/118 |
| 4,107,797 | A | * | 8/1978 | Maxwell, Sr. | 5/118 |
| 4,144,601 | A | * | 3/1979 | Anderson et al. | 5/118 |
| 4,196,483 | A | * | 4/1980 | Lefler et al. | 5/118 |
| 4,497,078 | A | * | 2/1985 | Vogel et al. | 5/118 |
| 4,541,134 | A | * | 9/1985 | Black et al. | 5/118 |
| 4,586,492 | A | * | 5/1986 | Manahan | 5/608 X |
| 4,669,139 | A | | 6/1987 | Richter, Jr. | 5/118 |
| 4,868,939 | A | * | 9/1989 | Tagtow | 5/118 X |
| 4,979,248 | A | * | 12/1990 | Kelley | 5/118 |
| 4,989,281 | A | | 2/1991 | Christensen | 5/118 |
| 5,218,728 | A | * | 6/1993 | Lloyd et al. | 5/118 |
| 5,305,482 | A | | 4/1994 | Dewert | 5/616 |
| 5,481,769 | A | * | 1/1996 | Schneider | 5/617 |
| 5,598,591 | A | | 2/1997 | Kelley | 5/118 |
| 6,263,527 | B1 | * | 7/2001 | Ross et al. | 5/118 |
| 6,493,886 | B1 | * | 12/2002 | Vanpage et al. | 5/118 |
| 6,505,362 | B1 | * | 1/2003 | Scipio | 5/118 |
| 2001/0044959 | A1 | * | 11/2001 | Davis | 5/118 |

* cited by examiner

*Primary Examiner*—Robert G. Santos
(74) *Attorney, Agent, or Firm*—Wood, Herron & Evans L.L.P.

(57) ABSTRACT

In one aspect of the invention, an adjustable bed system is contained within a truck sleeper compartment. The adjustable bed system includes: a base frame; an upper-body frame system and a lower-body frame system, with each frame system being pivotally attached at one end to the base frame and pivotable from a horizontal position to a position which is at an acute angle with the horizontal position; a first adjustable-linkage system adjustably connecting the upper-body frame system to the base frame; and a second adjustable-linkage system adjustably connecting the lower-body frame system to the base frame.

8 Claims, 5 Drawing Sheets

ADJUSTABLE BED SYSTEM

CROSS-REFERENCE TO RELATED APPLICATION

This application claims the benefit of the filing date of Provisional U.S. Patent Application No. 60/253,065 entitled "Adjustable Bed System" and filed on Nov. 24, 2000. The entire disclosure of Provisional U.S. Application No. 60/253,065 is incorporated into this application by reference.

BACKGROUND OF THE INVENTION

Field of Invention

This invention relates to adjustable beds and more particularly, to adjustable beds suitable for use in confined spaces. Such spaces may include, for example, truck sleeper compartments, recreational vehicles, and flat-top camper trailers.

Description of the Related Art

Many, if not most, of the world's long-haul trucks have not only a cab, but also a sleeper compartment adjacent the rear of the cab. Sleeper compartments offer several benefits to long-haul drivers and to employers of long-haul drivers. For example, a sleeping compartment enables a driver to pull off of a highway, stop driving, and sleep or relax almost anywhere at almost any time. A sleeping compartment also enables a driver to minimize his or her use of hotels and motels, thereby avoiding the impersonal nature and substantial cumulative cost associated with such lodgings. In addition, if two drivers share a truck at the same time, a sleeping compartment allows one driver to rest or sleep while the other driver drives the vehicle.

As economies around the world grow, more and more goods are being shipped via the trucking industry. In the United States alone, there are approximately 2,400,000 trucks with sleeper compartments. Moreover, approximately 120,000 new trucks with sleeper compartments are built in the United States each year.

In order to increase highway safety, many jurisdictions around the world have adopted, or will adopt, rules limiting the number of hours a driver may drive without taking a several-hour sleep break or rest break. Moreover, many of the newer regulations actually have reduced the number of hours of continuous driving time, relative to prior standards and regulations. Accordingly, in many jurisdictions, long-haul drivers are spending less time driving, while spending more time in their sleeping compartments.

The majority of the sleeping compartments in use today include a flat surface with a mattress or pad positioned on the surface. While many drivers find that this flat bunk-type surface is tolerable for napping or sleeping, they find that this set-up severely limits the ways in which these drivers are able to use this precious space. For example, many drivers want to be able to sit up at an angle in a sleeping compartment, in order to read, watch television or video tapes, work on a laptop computer, and the like. Because of the need to get more out of this limited space, drivers have come up with a relatively unsatisfactory "solution". In further detail, a driver typically puts lots of pillows on the mattress or pad, and then adjusts or shifts the pillows in an attempt to achieve a desired level of support or incline. However, the bunched up pillows barely provide the desired level of support or incline; and if they do, the positioning is relatively short-lived, as the pillows move and shift, which leads to relatively frustrated drivers.

For better or for worse, the trucking industry in most countries cannot afford to have frustrated drivers. As noted briefly above, there is an increased customer demand for truck transportation. Accordingly, there has been a corresponding increase in the demand for truck drivers. However, because of a relatively tight labor force in many of the industrialized countries, there is a shortage of drivers. Accordingly, the trucking industry in these areas wants to do what it can to both retain existing drivers and attract new drivers.

The conventional, flat, bunk-type surfaces found in most sleeping compartments also do little to alleviate specific health problems. For example, many doctors recommend that, while napping or sleeping, a person should have his or her upper body in an elevated position in order to alleviate respiratory problems such as asthma, sleep apnea, snoring, and emphysema. Many doctors also recommend keeping the upper body in an elevated position while resting or sleeping in order to ease symptoms with a hiatal hernia and with acid-reflex syndrome. In addition, many doctors recommend maintaining the legs in an elevated position while sleeping or resting, in order to improve circulation in the legs and to inhibit swelling of the legs. While these health issues are not new, they are becoming more important as truck drivers and employers become more health-conscious and recognize the impact of health on personal happiness and productivity.

Richter, Jr., U.S. Pat. No. 4,669,139 discloses a rather elaborate, air-powered, air-cushioned, multi-positional, reclining sleeper bed. This air-powered bed includes a pair of vertically-oriented air springs, with each air spring being made of a deformable material surrounded by a steel coil and being connected to the compressed air system of the truck. Apparently, however, the number of sleeper compartments which incorporate such compressed-air-driven systems are relatively few. This may be due, for example, to factors such as weight, bulk, cost, installation difficulty and/or relative ease of adjustment.

Accordingly, what is needed is an adjustable bed which is: durable, yet lightweight; non-bulky; inexpensive; easy to install; and easy to adjust.

SUMMARY OF THE INVENTION

The invention addresses the limitations discussed above by providing an adjustable bed system which is made of durable, yet lightweight, relatively inexpensive materials. In addition, the adjustable bed system has relatively few components, making the system non-bulky and easy to install. Also, the system design allows a driver to easily adjust various portions of the bed from a horizontal position to any of a number of different inclined positions, thereby allowing the driver to elevate his or her upper body and/or lower body as desired.

One aspect of the invention is directed to an adjustable bed system contained within a truck sleeper compartment. This adjustable bed system includes a base frame, an upper-body frame system, a lower-body frame system, a first adjustable-linkage system adjustably connecting the upper-body frame system to the base frame, and a second adjustable-linkage system adjustably connecting the lower-body frame system to the base frame. The upper-body frame system is pivotably attached at one end to the base frame, and is pivotable from a horizontal position to a position which is at an acute angle with the horizontal position. The lower-body frame system also is pivotably attached at one end to the base frame, and is pivotable from a horizontal position to a position which is at an acute angle with the horizontal position.

Another aspect of the invention is directed to an adjustable bed system in which the base frame has oppositely-disposed first and second side-members. The first side-member includes an upper section pivotally connected to a lower section, and the second side-member likewise includes an upper section pivotally connected to a lower section. This pivoting feature enables the base frame to be "collapsed", or folded over on itself, when the bed system is in a partially-assembled state.

In a further aspect, the upper-body frame system may include first and second frame-elements, with each frame-element being pivotably attached at one end to the base frame. Also, the base frame may have oppositely-disposed first and second side-members, with the upper-body frame-system first frame-element being attached at one end to the first side-member, and the upper-body frame system second frame-element being attached at one end to the second side-member.

In yet another aspect, the first adjustable-linkage may include first and second telescoping-fittings, with each fitting having a plurality of user-selectable settings, whereby a user may selectively adjust the length of the fitting. The first fitting telescopically connects the upper-body frame-system first frame-element to the first side-member, and the second fitting telescopically connects the upper-body frame system second-element to the second side-member.

In another aspect of the invention, the lower-body frame system may include first and second frame-elements, with each frame-element being pivotally attached at one end to the base frame. Also, the base frame may include oppositely-disposed first and second side-members, with the lower-body frame-system first-frame element being attached at one end to the first side-member, and the lower-body frame-system second frame-element being attached at one end to the second side-member.

In yet a further aspect, the second adjustable-linkage system may include first and second telescoping-fittings, with each fitting having a plurality of user-selectable settings, whereby a user may selectively adjust the length of the fitting. The first fitting telescopically connects the lower-body frame-system first frame-element to the first side-member, and the second fitting telescopically connects the lower-body frame-system second frame-element to the second side-member.

In yet another aspect, the adjustable bed system, according to the principles of the invention, may further include an upper-body support surface attached to the upper-body frame system, as well as a lower-body support surface attached to the lower-body frame system. In addition, if desired, the adjustable bed system may have a middle support surface, with the middle support surface being attached to the base frame and positioned between the upper-body frame system and the lower-body frame system.

In an additional aspect, the adjustable bed system may be provided in combination with a mattress or pad which is constructed and arranged for positioning on the adjustable bed system.

Additional aspects and advantages of the present invention will become readily apparent from viewing the drawings and reading the detailed description of the drawings.

BRIEF DESCRIPTION OF THE DRAWINGS

The accompanying drawings, which are incorporated in, and constitute a part of, this specification, illustrate embodiments of the invention, and, together with the general description of the invention given above, and the detailed description of the drawings given below, serve to explain the principles of the invention.

DETAILED DESCRIPTION OF THE DRAWINGS

Figure 1:
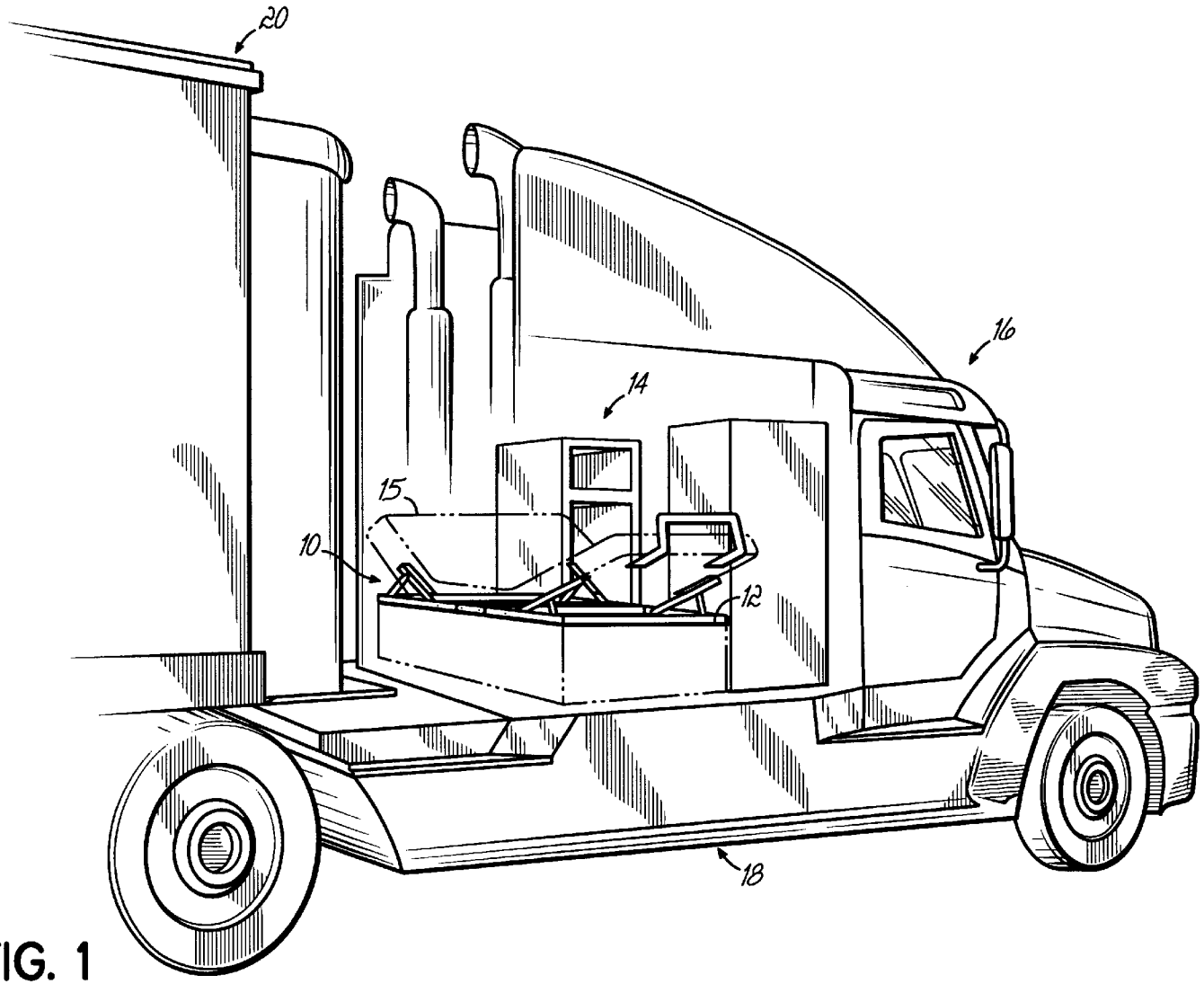
FIG. 1 is a perspective view of an adjustable bed system in combination with a truck sleeper compartment of a truck-trailer rig.

As shown in FIG. 1, a version of the adjustable bed system 10 is positioned on a flat support surface 12 of a truck sleeper compartment 14, and a mattress 15 is positioned on the adjustable bed system 10. The truck sleeper compartment 14 and a truck cab 16 are mounted on a chassis 18, and a trailer 20 is attached to the truck, thereby forming a truck-trailer rig. The particular adjustable bed system 10 shown in FIGS. 1 and 2 includes a base frame 22, an upper-body frame system 24, a lower-body frame system 26, a first adjustable-linkage system 28, and a second adjustable-linkage system 30. In further detail, each of the upper-body and lower-body frame systems 24, 26 is pivotally attached at one end to the base frame 22, and is pivotable from a horizontal position to a position which is at an acute angle with the horizontal position. The first adjustable-linkage system 28 adjustably connects the upper-body frame system 24 to the base frame 22, and the second adjustable-linkage system 30 adjustably connects the lower-body frame system 26 to the base frame 22.

Figure 2:
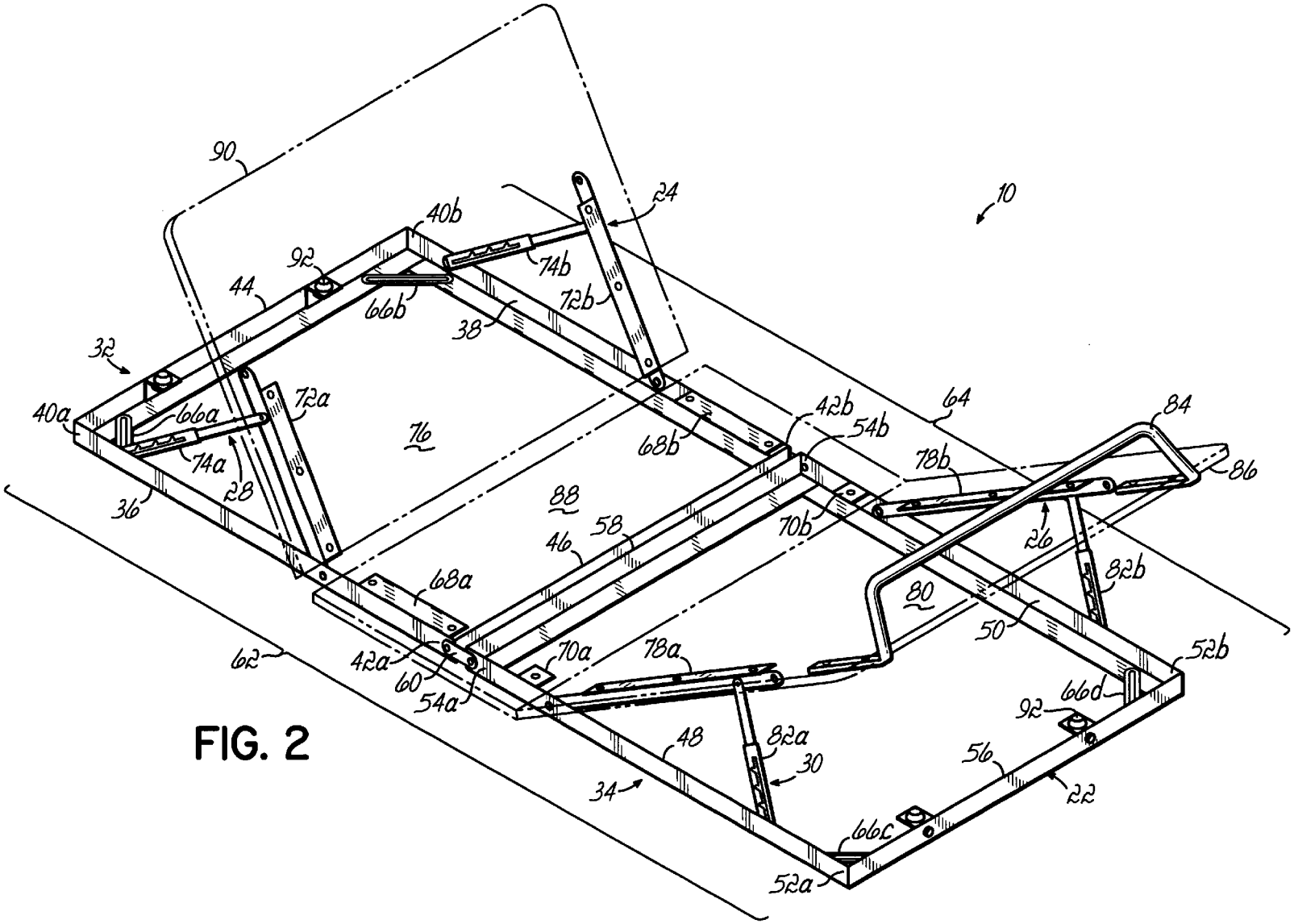
FIG. 2 is a perspective view of the version of the adjustable bed system shown in FIG. 1.

As best seen in FIG. 2, the base frame 22 is made up of a first rectangular-frame subassembly 32 pivotally connected to a second rectangular-frame subassembly 34. The first subassembly 32 has a longitudinal upper section 36 and a longitudinal upper section 38 spaced apart from the upper section 36, with each of these upper sections 36, 38 having a header end 40*a,b* and an inner end 42*a,b*. The upper sections 36, 38 are connected at their header ends 40*a,b* by a transverse header member 44, and at their inner ends 42*a,b* by a transverse inner member 46, thereby forming the first rectangular frame subassembly 32. The second rectangular-frame subassembly 34 similarly has a longitudinal lower section 48 and a longitudinal lower section 50 spaced apart from the lower section 48, with each lower section 48, 50 having a footer end 52*a,b* and an inner end 54*a,b*. The footer ends 52*a,b* are connected to each other by a transversely-extending footer member 56, and the inner ends 54*a,b* are connected to each other by a transversely-extending inner member 58, thereby forming the second rectangular frame subassembly 34.

The pivoting feature of the base frame 22 is created by orienting the inner member 46 of the first subassembly 32 adjacent, and parallel to, the inner member 58 of the second subassembly 34. In addition, the inner ends 42*a*, 54*a* of the first and second subassembly upper and lower sections 36, 48 are pivotally connected using a linking element 60, and the inner ends 42*b*, 54*b* of the first and second subassembly upper and lower sections 38, 50 are pivotally connected by a similar linking element (not shown). This pivoting feature of the invention provides several benefits. For example, when an adjustable bed system 10 is shipped, it typically is shipped without the various support surfaces (discussed in detail below) attached to either the base frame 22 or the upper-body and lower-body frame systems 24, 26 of the adjustable bed system 10. Accordingly, the base frame 22 may be "collapsed", or folded over upon itself, so that it is shorter in length. This is a tremendous benefit, not only during the shipping process, but also during the assembly process. In particular, this feature enables a truck driver or other installer to single-handedly bring the base frame 22, in its collapsed state, into the truck sleeper compartment, and then proceed to "unfold" the frame 22, and continue the installation process.

As seen in FIG. 2, the base frame 22 is shown in its unfolded, or fully opened position. This Figure illustrates that the upper section 36 of the first frame subassembly 32, the lower section 48 of the second frame subassembly 34, and the linking element 60 combine to form a longitudinal first side-member 62 of the base frame 22. In addition, the Figure shows that the upper section 38 of the first frame subassembly 32, the lower section 50 of the second frame subassembly 34, and the linking element (not shown) combine to form a longitudinal second side-member 64 of the base frame 22.

As shown in FIG. 2, the first and second frame subassemblies 32, 34 are formed of angle elements, with the angle elements being secured to each other using any conventional method (not shown). The first frame subassembly 32 further includes a corner brace 66*a* connecting the upper section 36 to the header member 44, and a corner brace 66*b* connecting the upper section 38 to the header member 44, with these corner braces 66*a,b* adding strength and rigidity to the first frame subassembly 32. The first frame subassembly 32 also has a longitudinally-oriented angle element 68*a* secured to the upper section 36 adjacent the section's inner end 42*a*, and a similar angle element 68*b* connected to the upper section 38 adjacent that section's inner end 42*b*.

The second frame subassembly 34 has a pair of corner braces 66*c,d*, with the brace 66*c* connecting the lower section 48 to the footer member 56, and the brace 66*d* connecting the lower section 50 to the footer member 56. The second frame subassembly 34 further has an angle element 70*a* connected to the lower section 48 adjacent the section's inner end 54*a*, and a similar angle element 70*b* connected to the lower section 50 adjacent that section's inner end 54*b*. As seen in FIG. 2, and discussed in further detail below, the angle elements 68, 70 connected to the first and second frame subassemblies 32, 34 adjacent the subassembly inner ends 42, 54 may be used to releasably attach a middle support surface 88 to the base frame 22.

The upper-body frame system 24 includes first and second frame elements 72*a,b*, with the first frame element 72*a* being pivotally attached at one end to the upper section 36 of the first frame subassembly 32, and the second frame element 72*b* being pivotally attached at one end to the upper section 38 of the first frame subassembly 32. As shown, each frame element 72*a,b* is an angle element, thereby readily providing points of attachment for the first adjustable-linkage system 28 and the upper-body support surface 76, both of which are discussed in further detail below.

The first adjustable-linkage system 28 includes first and second telescoping fittings 74*a,b*, with each fitting having a plurality of user-selectable settings, whereby a user may selectively adjust the length of the fitting. The first fitting 74*a* telescopically connects the upper-body frame-system first frame-element 72*a* to the upper section 36 of the base frame 22, and the second fitting 74*b* telescopically connects the upper-body frame-system second-frame element 72*b* to the upper section 38 of the base frame 22. With an upper-body support surface 76 releasably fastened to the first and second frame elements 72*a,b* of the upper-body frame system 24, a user easily may adjust the angle of incline of the upper-body support surface 76 between a horizontal position and any of a number of acute angle positions.

With regard to the telescopic fittings 74*a,b*, if desired, any of the telescopic fittings made by Franko Co. (also referred to as Mobelbeschlage or Franke GmbH & Co. KG) of Balingen, Germany, and often referred to by the product name "Rastomat", may be used. One particular example is the Rastomat telescopic fitting which offers six different incline settings in addition to a retracted, horizontal position.

Each Rastomet telescoping fitting includes an inner frame which is telescopically received within an outer frame. In use, as a driver or other user increases the acute angle of the upper-body support surface 76 or the lower-body support surface 80 relative to a horizontal orientation, the length of the fitting increases as the inner frame begins to telescope outward along the longitudinal axis of the fitting. The inner frame includes a spring-loaded latch toward its inner end, with the latch including a transversely-extending projecting pin. As the fitting is elongated, the pin engages one of a series of detents in a track on each sidewall of the outer frame, thereby enabling a user to selectively adjust the angle of incline.

Once a user selects a particular incline position, the fitting will allow a user to increase the angle of incline to any of the various user-selectable positions. In order to decrease the length of the fitting, and therefore the angle of incline, a user simply may increase the angle of incline slightly, such that the pin raises up and out of the given detent and onto the main track wall. So long as the user does not increase the angle of incline such that the pin engages a subsequent detent, the user may lower the upper-body and/or lower-body support surface(s). In doing so, the user causes the pin to engage a recess in a plastic spacer, which compresses the spring of the spring-loaded latch, and maintains the pin in a non-engaging position. The spacer is located in the interior space of the outer frame, and is slidingly connected to the inner frame.

Although the fitting may be operated as described above, a user may find that, in returning the upper-body or lower-body support surface 76, 80 to a horizontal position, or to a less-inclined position, it is easiest simply to fully incline the upper-body or lower-body support surface 76, 80, allow the surface to return to its horizontal position, and then, if desired, elevate the support surface to a different position.

The lower-body frame system 26 includes first and second frame-elements 78*a,b*, with each frame element 78*a,b* being pivotally attached at one end to the base frame 22. As shown, these frame elements 78*a,b* are angle elements, thereby providing multiple surfaces for easy attachment of the second adjustable-linkage system 30 and lower-body support surface 80, both of which are discussed in further detail below.

The second adjustable-linkage system 30 includes first and second telescopic-fittings 82*a,b*, with each fitting having a plurality of user-selectable settings, whereby a user may selectively adjust the length of the fitting. The first fitting 82*a* telescopically connects the lower-body frame-system first frame-element 78*a* to the lower section 48 of the base frame 22, and the second fitting 82*b* telescopically connects the lower-body frame-system second frame-element 78*b* to the lower section 50 of the base frame 22. A lower-body support surface 80 is releasably fastened to the first and second frame elements 78*a,b*, with the lower-body support surface 80 including a mattress retainer 84 at the footer end 86 of the support surface 80, and attached to the support surface 80 along its lower-facing side (not shown).

If desired, the first and second telescoping-fittings 82*a,b* of the second adjustable-linkage system 30 may be "Rastomat" telescoping fittings made by Franko Co. of Balingen, Germany, as described in detail above in connection with the fittings 74*a,b* of the first adjustable-linkage system 28. For example, a Rastomat fitting having five user-selectable incline positions, in addition to a horizontal position, may be used.

As shown in FIG. 2, the middle support surface 88, which is releasably attached to the base frame 22, provides several functions. For example, it provides a support surface which remains in a horizontal orientation throughout the use of the adjustable bed system 10. In addition, the middle support surface 88 adds strength and rigidity to the adjustable bed system 10 when it is securely fastened to the first and second frame subassemblies 32, 34, because it prevents the pivotally-connected subassemblies from being folded over onto one another. If desired, the surface 88 may be attached to the frame 22 via the angle elements 68, 70.

If desired, the header-end 90 of the upper-body support surface 76 and/or the footer-end 86 of the lower-body support surface 80 may be provided with one or more handles, straps, or the like, thereby allowing a user to easily raise or lower the respective support surfaces 76, 80, even when a mattress 15 (see FIG. 1) or sleeping pad is positioned on the adjustable bed system 10, and even when the bed system 10 is positioned in a tight space, such as a truck sleeper compartment 14.

In making the adjustable bed system, any suitable materials may be used, as will be appreciated by one of ordinary skill in the art upon reading this specification. For example, if desired, angle elements made of angle iron may be used to form the first and second frame assemblies, as well as the upper-body and lower-body frame systems. Other non-limiting examples of materials for use in making such components include wood and plastic. Holes may be punched, drilled, or otherwise formed in these materials, as understood by those of ordinary skill. In addition, the materials may be secured to each other using any suitable fastening technique, including, for example, riveting, bolting, welding and/or adhesive bonding.

If desired, the upper-body and lower-body frame systems may be pivotally attached to the base frame using nuts and bolts, as well as plastic spacers or bushings, with the plastic bushings assisting in providing a smooth pivoting movement. In addition, the first and second adjustable-linkage systems may be connected to their respective upper-body and lower-body frame systems and base frame also using nuts, bolts, and plastic spacers or bushings, thereby further facilitating a smooth motion as the angle of incline of the upper-body support surface and/or lower-body support surface is adjusted by a user. If desired, a clinch nut may be used in place of a conventional nut, wherever a nut-and-bolt system is used to connect a component to an angle element. In such a case, the clinch nut is fused onto the angle element, as will be understood by those of ordinary skill.

As with the other components of the adjustable bed system, the various support surfaces may be made of any suitable material, as will be appreciated by one of ordinary skill in the art. Non-limiting examples include wood, plastic, metal, and combinations thereof. If desired, each of the upper-body, middle, and lower-body support surfaces may be made of one-half inch, seven laminate, cabinet-grade plywood. This material is extremely durable, relatively lightweight, and relatively inexpensive. Typically, holes are drilled in each of the support surfaces, so that the surfaces may be releasably attached to their corresponding frames using a nut-and-bolt fastening system. In addition, if desired, bumpers may be installed on the adjustable bed system. For example, bumpers may be positioned on the base frame and/or the lower surface of the upper-body, middle, and/or lower body support surfaces, such that the lower surface of one or more of the support surfaces contacts the bumper(s) directly, instead of contacting the base frame directly. As shown in FIG. 2, bumpers may be positioned along the header member 44 and footer member 56, as at 92. If desired, the bumpers may be made of a resilient material, such as rubber or the like.

In making the adjustable bed system, it may be beneficial to: assemble the base frame; assemble the upper-body and lower-body frame systems and attach them to the base frame; and assemble the first and second adjustable-linkage systems, and attach them to the upper-body and lower-body frame systems, and to the base frame. However, it may be beneficial not to releasably fasten the various support surfaces to the upper-body and lower-body frame system and the base frame. In this fashion, the first and second frame subassemblies may be folded together for easy shipping. These few components then may be shipped in a relatively compact shipping container, and the driver or other installer easily may assemble the components to form the adjustable bed system.

Figure 3:
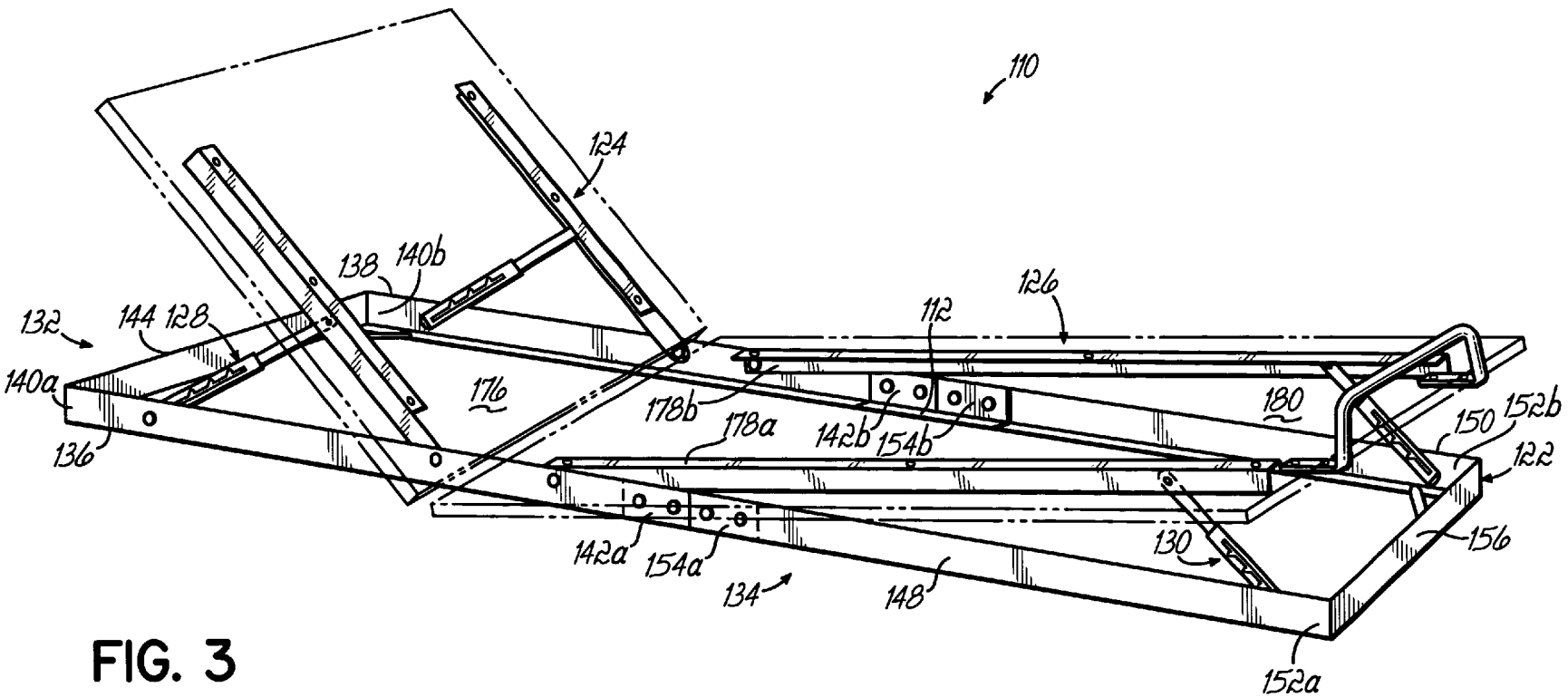
FIG. 3 is a perspective view of another version of the adjustable bed system.

With reference to FIG. 3, another version of the adjustable bed system 110, in accordance with the principles of the invention, includes a base frame 122, an upper-body frame system 124, a lower-body frame system 126, a first adjustable-linkage system 128, a second adjustable-linkage system 130, an upper-body support surface 176 releasably attached to the upper-body frame system 124, and a lower-body support surface 180 releasably attached to the lower-body frame system 126. Because this version of the invention is quite similar to the one shown in FIG. 2, only the features of the adjustable bed system 110 which differ from the adjustable bed system 10 of FIG. 2 are described in detail. These distinctions include: the base frame 122; the absence of a middle support surface; the lower-body frame system 126; and the lower-body support surface 180.

As seen in FIG. 3, the rectangular base frame 122 includes a first frame subassembly 132 and a second frame subassembly 134. However, these two subassemblies 132, 134 are not independent, pivotally-connected rectangles. Instead, they are substantially "U-shaped", with the subassemblies 132, 134 being joined together at the upper ends of the respective "U"s. The first frame subassembly 132 has a longitudinal upper section 136 and a longitudinal upper section 138 spaced apart from the section 136, with each of these sections 136, 138 having a header end 140*a, b* and an inner end 142*a, b*. The sections 136, 138 are connected at their header ends 140*a, b* by a transverse header member 144, thereby forming the subassembly 132. The second frame subassembly 134, similarly has a longitudinal lower section 148 spaced apart from a longitudinal lower section 150, with each section 148, 150 having a footer end 152*a, b* and an inner end 154*a, b*. The footer ends 152*a, b* are connected to each other by a transversely-extending footer member 156, thereby forming the subassembly 134.

As shown, the inner ends 142*b*, 154*b* are positioned in abutting relationship with one another, and are firmly connected together using a length of angle element 112 which spans both ends 142*b*, 154*b*. In addition, the inner ends 142*a*, 154*a* are positioned in abutting relationship with one another, and are firmly connected together using a length of angle element (not shown) which spans both ends 142*a*, 154*a*. Both the inner ends 142, 154 and the corresponding angle elements 112 include holes for receiving nuts and bolts, which may be used to securely fasten the two frame subassemblies 132, 134. In this fashion, the two subassemblies 132, 134 may remain in an unattached state for shipping purposes, thereby enabling the adjustable system 110 to be shipped more easily, and enabling a driver or other installer to bring the components into a sleeper compartment for final assembly of the adjustable bed system 110.

Rather than having three support surfaces, the adjustable bed system 110 shown has two support surfaces, an upper-body support surface 176 and a lower-body support surface 180. Given this design, the lower-body frame system 126 is pivotally attached at one end to the first frame subassembly 132, as opposed to the second frame subassembly 134 as is done with the adjustable bed system 10 shown in FIG. 2. If desired, and as shown in FIG. 3, the first and second-frame elements 178*a,b* of the lower-body frame system 126 may be somewhat longer than those 78*a, b* of the adjustable bed system 10 of FIG. 2. Also, as shown, the surface 180 is longer than the surface 80 of the system 10.

Figure 4:
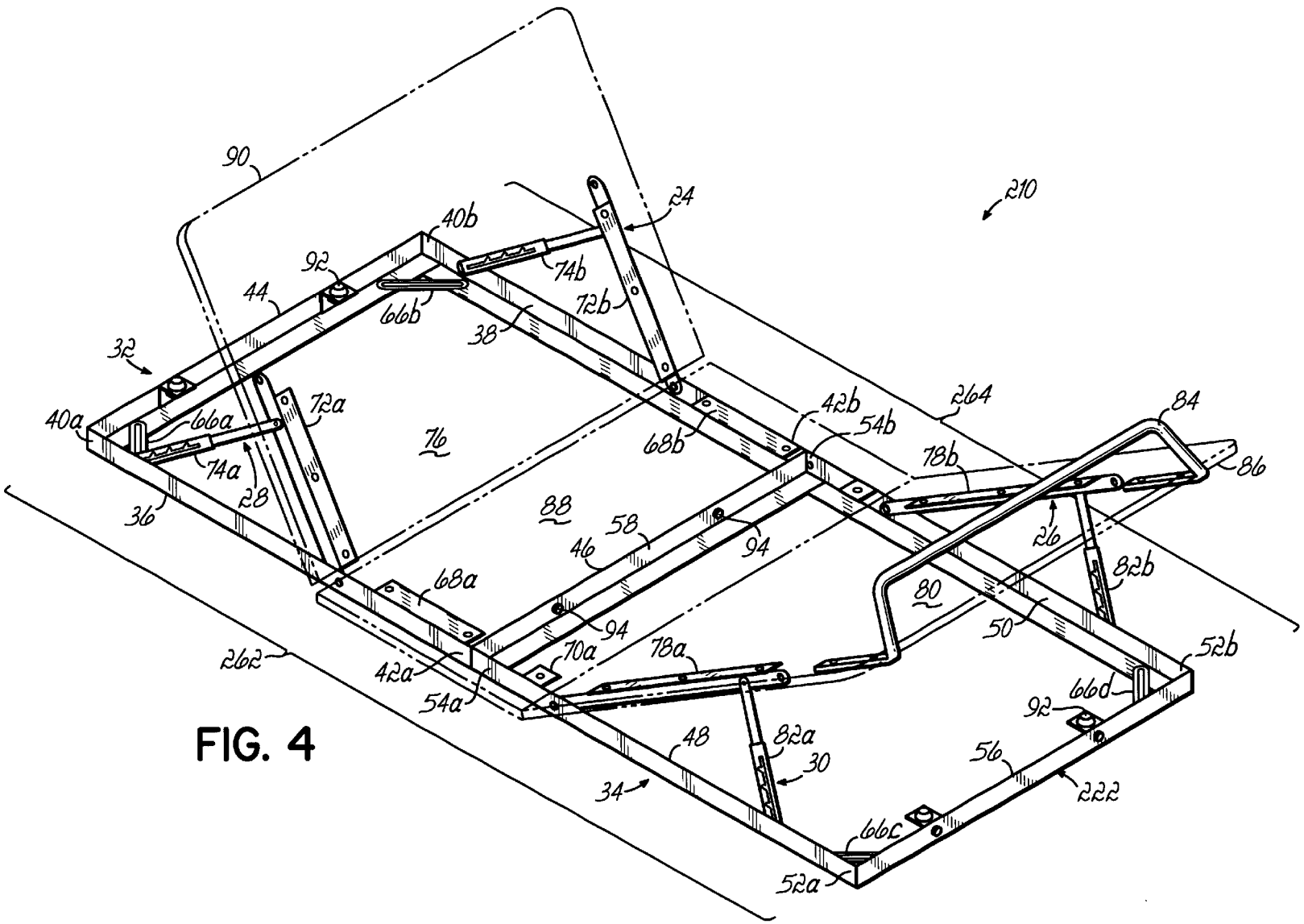
FIG. 4 is a perspective view of a further version of the adjustable bed system.

With reference to FIG. 4, another version of the adjustable bed system 210 is shown, with the system 210 being nearly identical to the system 10 in FIG. 2. Because the version 210 of the invention is so similar to the system 10 shown in FIG. 2, only the features of the adjustable bed system 210 which differ from the adjustable bed system 10 are described in detail. In particular, the system 210 does not include the linking elements 60 of the system 10. Instead, the first subassembly 32 is connected directly to the second subassembly 34 by fastening the transverse inner member 46 directly to the transversely-extending inner member 58. Any suitable fastening technique may be used, with one example being a plurality of nut-and-bolt assemblies, as at 94.

Accordingly, with the system 210, the base frame 222 does not have the pivoting feature found in the base frame 22. In addition, the longitudinal first side-member 262 of the base frame 222 is formed by the combination of the upper section 36 of the first frame subassembly 32 and the lower section 48 of the second frame subassembly 34. Likewise, the longitudinal second side-member 264 of the base frame 222 is formed by the combination of the upper section 38 of the first frame subassembly 32 and the lower section 50 of the second frame subassembly 34.

The adjustable bed system 210 offers several benefits. For example, if desired, the first and second frame subassemblies 32,34 may be fastened to each other at the end-user location, thereby allowing for more-compact shipping to the end user. In addition, the direct connection of the transverse inner member 46 to the transversely-extending inner member 58 assists in enhancing the overall rigidity of the base frame 222. The remainder of the system 210 may be assembled as described above in connection with the system 10.

Figure 5:
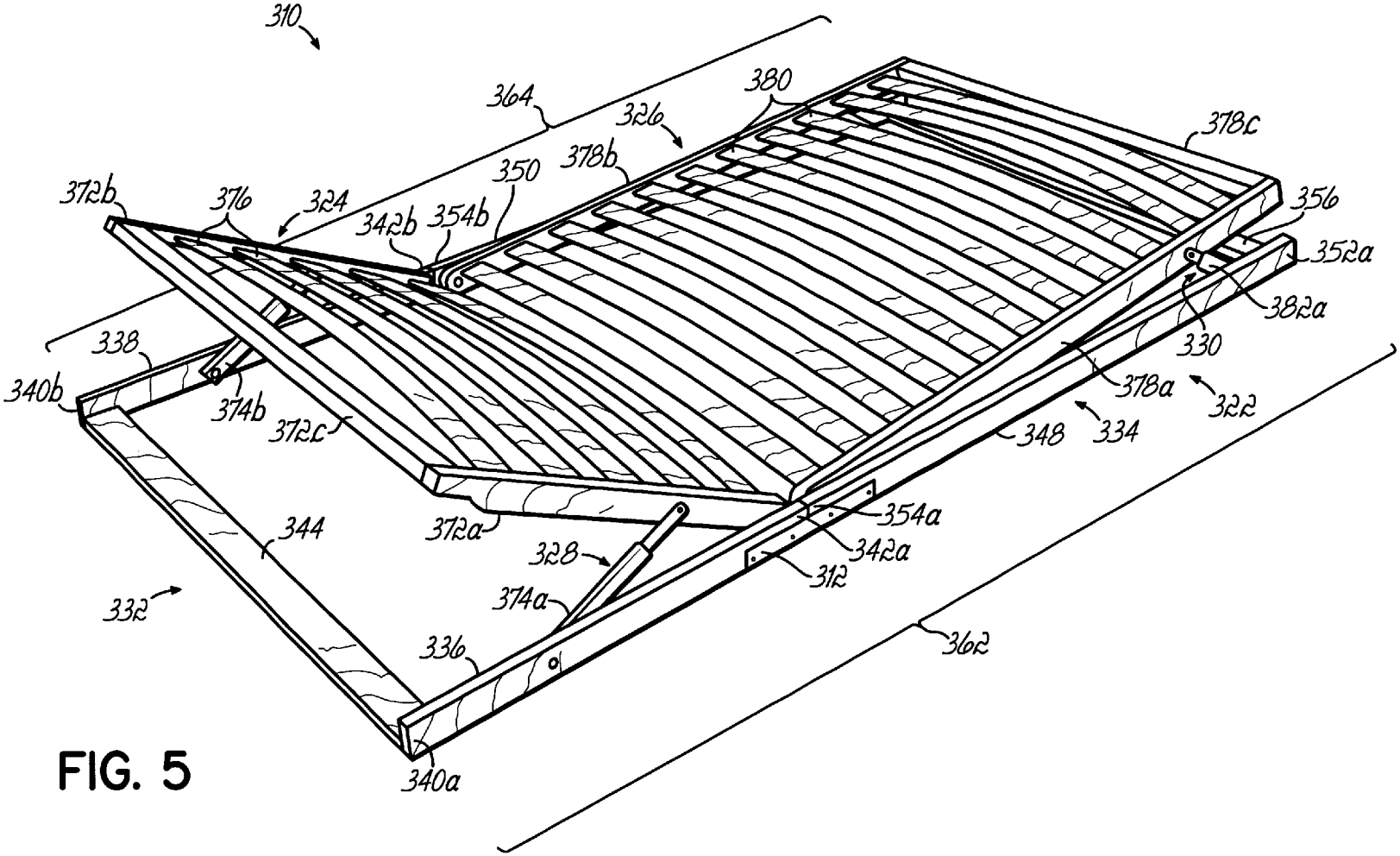
FIG. 5 is a perspective view of yet another version of the adjustable bed system.

With reference to FIG. 5, another version of the adjustable bed system 310 has an upper-body support surface formed by a plurality of slats 376, and a lower-body support surface formed by a plurality of slats 380. This system 310 further includes a base frame 322, an upper-body frame system 324, a lower-body frame system 326, a first adjustable-linkage system 328, and a second adjustable-linkage system 330. In further detail, each of the upper-body and lower-body frame systems 324, 326 is pivotally attached at one end to the base frame 322, and is pivotable from a horizontal position to a position which is at an acute angle with the horizontal position. The first adjustable-linkage system 328 adjustably connects the upper-body frame system 324 to the base frame 322, and the second adjustable-linkage system 330 adjustably connects the lower-body frame system 326 to the base frame 322.

The rectangular base frame 322 includes a first frame subassembly 332 and a second frame subassembly 334. Each subassembly 332, 334 is substantially "U-shaped", with the subassemblies 332, 334 being joined together at the upper ends of the respective "U". The first frame subassembly 332 has a longitudinal upper section 336 and a longitudinal upper section 338 spaced apart from the upper section 336, with each of these upper sections 336,338 having a header end 340*a,b* and an inner end 342*a,b*. The upper sections 336, 338 are connected at their header ends 340*a,b* by a transverse header member 344. The second frame subassembly 334 similarly has a longitudinal lower section 348 and a longitudinal lower section 350 spaced apart from the lower section 348, with the lower section 348 having a footer end 352*a* and an inner end 354*a*, and the lower section 350 having a footer end (not shown) and an inner end 354*b*. The footer ends 352 are connected to each other by a transversely-extending footer member 356. As shown, the inner ends 342*a*, 354*a* are positioned in abutting relationship with one another, and are firmly connected together using a connector plate 312 which spans both ends 342*a*, 354*a*. In addition, the inner ends 342*b*, 354*b* are positioned in abutting relationship with one another and are firmly connected together using a connector plate (not shown) which spans both ends 342*b*, 354*b*. Both the inner ends 342, 354 and the corresponding connector plates include holes for receiving nuts and bolts, which may be used to securely fasten the two frame subassemblies 332, 334. In this fashion, the two subassemblies 332, 334 may remain in an unattached state for shipping purposes, thereby enabling the adjustable system 310 to be shipped more easily, and enabling a driver or other installer to bring the components into a sleeper compartment for final assembly of the adjustable bed system 310. When the first and second frame subassemblies 332, 334 are positioned in abutting relationship, as described immediately above, upper section 336 and lower section 348 combine to form a longitudinal first side-member 362 of base frame 322, and upper section 338 and lower section 350 combine to form a longitudinal second side-member 364 of base frame 322.

The upper-body frame system 324 includes first, second, and third frame elements 372*a,b,c*, with the first frame element 372*a* being pivotally attached at one end to the upper section 336 of the first frame subassembly 332, and the second frame element 372*b* being pivotally attached at one end to the upper section 338 of the first frame subassembly 332. The third frame element 372*c* connects the first and second frame elements 372*a,b* adjacent their outer ends, thereby assisting in forming a strong upper-body frame system 324.

The first adjustable-linkage system 328 includes first and second telescoping fittings 374*a,b*, with each fitting having a plurality of user-selectable settings, whereby a user may selectively adjust the length of the fitting. The first fitting 374*a* telescopically connects the upper-body frame-system first frame-element 372*a* to the upper section 336 of the base frame 322; and the second fitting 374*b* telescopically connects the upper-body frame-system second-frame element 372*b* to the upper section 338 of the base frame 322. If desired, the telescopic fittings 374*a,b* may be fittings made by Franko Co. of Balingen, Germany, as described in detail above.

The lower-body frame system 326 includes first, second, and third frame-elements 378*a,b,c*, with each of the first and second frame elements 378*a,b* being pivotally attached at one end to the base frame 322. The third frame element 378*c* extends transversely between the first and second frame elements 378*a,b*, and connects these elements 378*a,b* at their outer ends, thereby assisting in providing a strong lower-body frame system 326.

The second adjustable-linkage system 330 includes a first telescopic fitting 382*a* and a second telescopic fitting (not shown), with each fitting having a plurality of user-selectable settings, whereby a user may selectively adjust the length of the fitting. The first fitting 382*a* telescopically connects the lower-body frame-system first-element 378*a* to the lower section 348 of the base frame 322; and the second telescopic fitting (not shown) connects the lower-body frame-system second-element 378*b* to the lower section 350 of the base frame 352. If desired, the telescopic fittings of the second adjustable-linkage system 330 may be fittings made by Franko Co. as described in detail above.

As noted briefly above, the upper-body support surface is formed by a plurality of slats 376, and the lower-body support surface is formed by a plurality of slats 380. In further detail and as shown in FIG. 5, the slats 376 extend transversely between, and are connected to, the first and second frame elements 372*a,b*. In a similar fashion, the slats 380 extend transversely between, and are connected to, the first and second frame elements 378*a,b*. In addition, each of the slats 376, 380 is slightly bowed in a convex orientation relative to the corresponding first and second frame elements 372*a,b* and 378*a,b*. This bowed feature provides an added degree of resilience to the upper-body and lower-body support surfaces provided by the slats 378, 380.

The adjustable bed system 310 may be made using conventional methods and materials. For example, if desired, the base frame 322, upper- and lower-body frame systems 324, 326, and slats 376, 380 may be made of one or more grades of multi-laminate plywood. In this fashion, the adjustable bed system 310 is not only durable, but also extremely light in weight, a factor which is particularly beneficial in the trucking industry. If desired, the connector plates may be metal plates which are screwed or otherwise fastened to the base frame. Also, if desired, and as described in detail above in connection with the adjustable bed system 10 shown in FIG. 2, the telescopic fittings 374, 382 may be attached to the various components of the system 310 using fasteners such as nuts and bolts or the like, either with or without plastic bushings or spacers. In addition, the pivoting ends of the upper-body and lower-body frame systems 324, 326 may be formed and attached to the base frame 322 using conventional hardware, such as nuts and bolts, with or without plastic spacers or bushings.

Another version of the adjustable bed system is an electrically-powered adjustable bed system (not shown). In this version, the system may use a 12-volt, direct-current power source, which is the conventional power source used in truck cabs and sleeper compartments. If desired, the adjustable bed system may be programmed so that it "remembers" either user-defined or factory-defined pre-settings for the adjustable support surfaces. In addition, the system may have a wireless or wired remote control unit, and may have one or more massage motors installed adjacent the upper-body, middle, and/or lower-body support sections.

While the invention has been illustrated by a description of various versions, and while the illustrative versions have been described in considerable detail, the inventor does not intend to restrict or in any way limit the scope of the appended claims to such detail. Additional advantages and modifications readily will appear to those of ordinary skill in the art. The invention, in its broader aspects, is therefore not limited to the specific details, representative apparatus and methods, and illustrative examples shown and described. Accordingly, departures may be made from such details without departing from the spirit or scope of the inventors' general inventive concept.

What is claimed is:

1. In combination with a truck sleeper compartment, an adjustable bed system contained within the truck sleeper compartment, the adjustable bed system comprising:

a base frame;

an upper-body frame system pivotally attached at one end to the base frame and pivotable from a horizontal position to a position at an acute angle with the horizontal position;

a lower-body frame system pivotally attached at one end to the base frame and pivotable from a horizontal position to a position at an acute angle with the horizontal position;

a first adjustable-linkage system adjustably connecting the upper-body frame system to the base frame; and a second adjustable-linkage system adjustably connecting the lower-body frame system to the base frame, wherein the base frame includes a first frame subassembly and a second frame subassembly, each of the first and second frame subassemblies having a longitudinal section, a spaced-apart longitudinal section, and a transverse member connecting the longitudinal section and the spaced-apart longitudinal section.

2. The combination of claim 1 wherein each of the longitudinal sections and the spaced-apart longitudinal sections has an inner end, with the longitudinal-section inner ends being adjacent each other, and the spaced-apart longitudinal-section inner ends being adjacent each other.

3. The combination of claim 2 wherein the longitudinal sections are fastened to each other using a connector element, and the spaced-apart longitudinal sections are fastened to each other using a connector element.

4. In combination with a truck sleeper compartment, an adjustable bed system contained within the truck sleeper compartment, the adjustable bed system comprising:

a base frame;

an upper-body frame system pivotally attached at one end to the base frame and pivotable from a horizontal position to a position at an acute angle with the horizontal position;

a lower-body frame system pivotally attached at one end to the base frame and pivotable from a horizontal position to a position at an acute angle with the horizontal position;

a first adjustable-linkage system adjustably connecting the upper-body frame system to the base frame; and a second adjustable-linkage system adjustably connecting the lower-body frame system to the base frame, wherein the base frame includes oppositely disposed first and second side members, each side member including an upper section pivotally connected to a lower section, whereby the base frame may be collapsed.

5. In combination with a truck sleeper compartment, an adjustable bed system contained within the truck sleeper compartment, the adjustable bed system comprising:

a base frame;

an upper-body frame system pivotally attached at one end to the base frame and pivotable from a horizontal position to a position at an acute angle with the, horizontal position;

a lower-body frame system pivotally attached at one end to the base frame and pivotable from a horizontal position to a position at an acute angle with the horizontal position;

a first adjustable-linkage system adjustably connecting the upper-body frame system to the base frame; and a second adjustable-linkage system adjustably connecting the lower-body frame system to the base frame, wherein the upper-body frame system includes first and second frame elements, each frame element pivotally attached at one end to the base frame, and wherein the base frame includes oppositely-disposed first and second side-members, the upper-body frame-system first frame-element attached at one end to the first side-member, and the upper-body frame-system second frame-element attached at one end to the second side-member.

6. The combination of claim 5 wherein the first adjustable-linkage system includes first and second telescoping-fittings, each fitting having a plurality of user-selectable settings, whereby a user may selectively adjust the length of the fitting, the first fitting telescopically connecting the upper-body frame-system first frame-element to the first side-member, and the second fitting telescopically connecting the upper-body frame-system second frame-element to the second side-member.

7. In combination with a truck sleeper compartment, an adjustable bed system contained within the truck sleeper compartment, the adjustable bed system comprising:

a base frame;

an upper-body frame system pivotally attached at one end to the base frame and pivotable from a horizontal position to a position at an acute angle with the horizontal position;

a lower-body frame system pivotally attached at one end to the base frame and pivotable from a horizontal position to a position at an acute angle with the horizontal position;

a first adjustable-linkage system adjustably connecting the upper-body frame system to the base frame; and a second adjustable-linkage system adjustably connecting the lower-body frame system to the base frame, wherein the lower-body frame system includes first and second frame-elements, each frame element pivotally attached at one end to the base frame, and wherein the base frame includes oppositely-disposed first and second side-members, the lower-body frame-system first frame-element attached at one end to the first side-member, and the lower-body frame-system second frame-element attached at one end to the second side-member.

8. The combination of claim 7 wherein the second adjustable-linkage system includes first and second telescoping-fittings, each fitting having a plurality of user-selectable settings, whereby a user may selectively adjust the length of the fitting, the first fitting telescopically connecting the lower-body frame-system first frame-element to the first side-member, and the second fitting telescopically connecting the lower-body frame-system second frame-element to the second side-member.

* * * * *

UNITED STATES PATENT AND TRADEMARK OFFICE

CERTIFICATE OF CORRECTION

PATENT NO. : 6,735,797 B1
DATED : May 18, 2004
INVENTOR(S) : Thomas P. Long et al.

It is certified that error appears in the above-identified patent and that said Letters Patent is hereby corrected as shown below:

Column 2,
Line 20, "and with acid-reflex syndrome." should read -- and with acid-reflux syndrome. --.

Column 12,
Line 3, "the inventor does not intend to" should read -- the inventors do not intend to --.

Column 13,
Line 4, "at an acute angle with the, horizontal position;" should read -- at an acute angle with the horizontal position; --.

Signed and Sealed this

Fifth Day of October, 2004

JON W. DUDAS
*Director of the United States Patent and Trademark Office*